US008047258B1

(12) United States Patent
Zeimet et al.

(10) Patent No.: US 8,047,258 B1
(45) Date of Patent: Nov. 1, 2011

(54) DIE CASTING METHOD FOR SEMI-SOLID BILLETS

(75) Inventors: Randall J. Zeimet, Oshkosh, WI (US); Mark P. Potratz, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 664 days.

(21) Appl. No.: 12/175,871

(22) Filed: Jul. 18, 2008

(51) Int. Cl.
*B22D 46/00* (2006.01)

(52) U.S. Cl. ..... 164/4.1; 164/312

(58) Field of Classification Search ..... 164/4.1, 164/47, 69.1, 80, 113, 131, 159, 169, 174, 164/271, 284, 312, 900; 72/253.1, 273, 343, 72/352

See application file for complete search history.

(56) References Cited

U.S. PATENT DOCUMENTS 3,650,312 A 3/1972 Allen
5,219,018 A 6/1993 Meyer
5,865,238 A 2/1999 Carden et al.
5,879,478 A 3/1999 Loue et al.
6,098,700 A 8/2000 Carden et al.
6,399,017 B1 6/2002 Norville et al.
6,402,367 B1 6/2002 Lu et al.
6,432,160 B1 8/2002 Norville et al.
6,637,927 B2 10/2003 Lu et al.
6,932,938 B2 8/2005 Norville et al.
6,962,189 B2 11/2005 Buckley
7,132,077 B2 11/2006 Norville et al.
7,296,611 B2 11/2007 Hirai et al.
2005/0167071 A1 * 8/2005 Kendall et al. ..... 164/72

* cited by examiner

*Primary Examiner* — Jessica L Ward
*Assistant Examiner* — Steven Ha
(74) *Attorney, Agent, or Firm* — William D. Lanyi

(57) ABSTRACT

A die casting method for use with semi-solid metal billets allows the removal of air from portions of the billet as it is compressed and deformed to flow into a cavity of a die. The die is formed in a manner that captures other potential defects and impurities in portions of the finished die cast product that can easily be removed subsequent to the completion of the die casting operation. The air is removed through passages formed in a generally cylindrical rod that extends through a second surface of the die to allow the air to flow from pockets formed by a concavity of the billet and through the air conduit to the atmosphere.

11 Claims, 6 Drawing Sheets

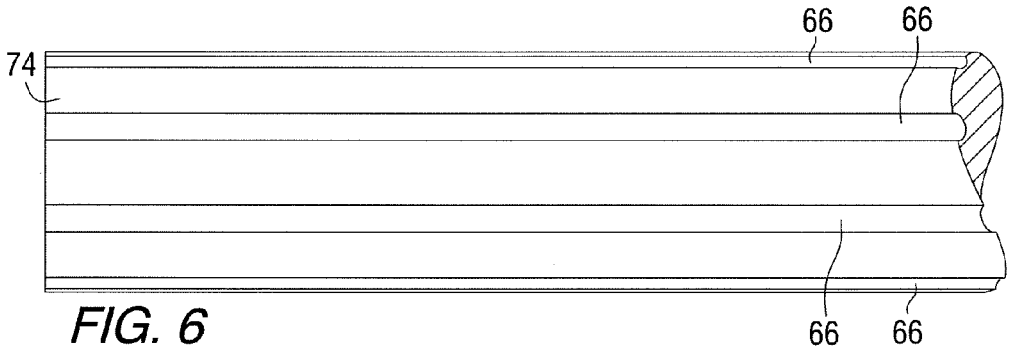
FIG. 6
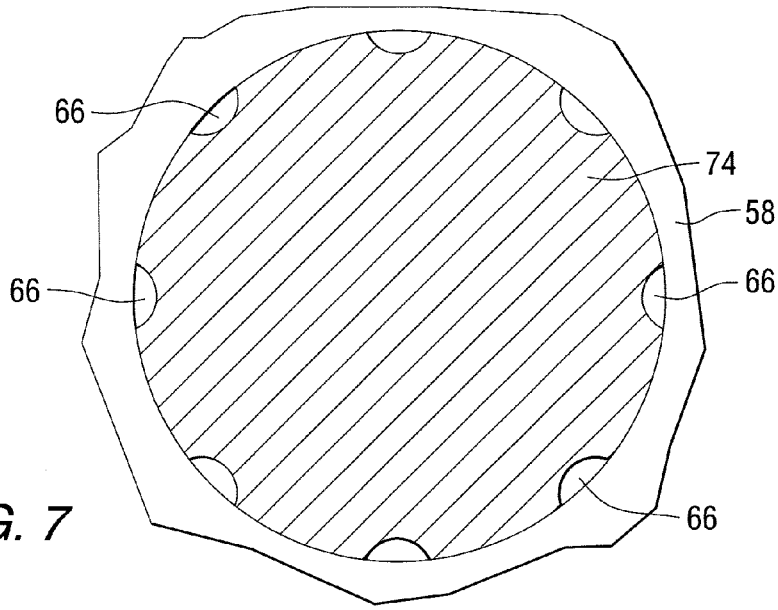
FIG. 7
FIG. 8
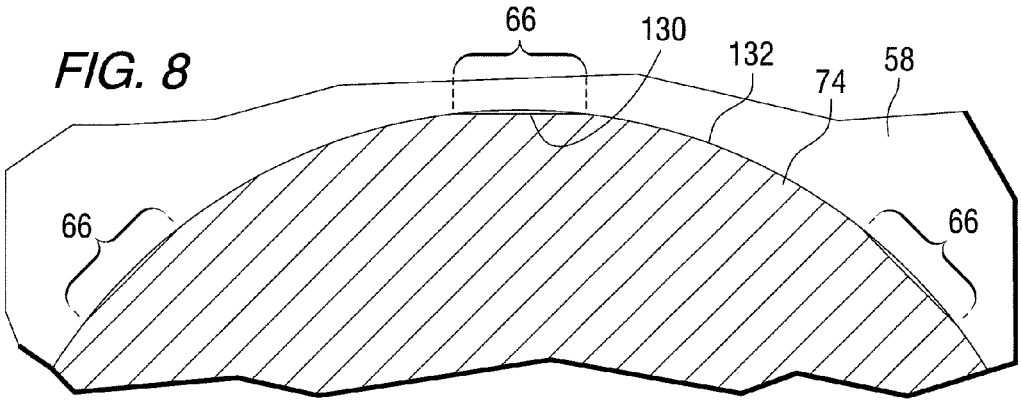

DIE CASTING METHOD FOR SEMI-SOLID BILLETS

BACKGROUND OF THE INVENTION

1. Field of the Invention

The present invention is generally related to semi-solid die casting and, more particularly, to a process for reducing the likelihood that impurities and air entrapment will adversely affect the quality of a die cast component.

2. Description of the Related Art

Those skilled in the art of die casting and, more particularly, die casting of semi-solid material are familiar with various processes and procedures associated with die casting methods.

U.S. Pat. No. 3,650,312, which issued to Allen on Mar. 21, 1972, describes a hybrid casting-hot working process for shaping magnesium, aluminum, zinc and other die casting metals. Molten metal is thickened by addition of high surface area aerogel powder to produce a thixotropic mass which is workable at low working forces and retains its worked shape after removal of the applied working forces. Cooling to below melting temperatures solidifies the mass into a product having the metallurgical structural characteristics of a forged metal notwithstanding the use of casting methods in fabrication.

U.S. Pat. No. 5,879,478, which issued to Loue et al. on Mar. 9, 1999, describes a process for semi-solid forming of thixotropic aluminum-silicon-copper alloys. It relates to an aluminum alloy for thixoforming with a particular composition which, when reheated to the semi-solid state to the point at which a liquid fraction ratio between 35 and 55% is obtained, has an absence of non-remelted polyhedral silicon crystals.

U.S. Pat. No. 5,219,018, which issued to Meyer on Jun. 15, 1993, describes a method of producing thixotropic metallic products by continuous casting with polyphase current electromagnetic agitation. The invention relates to a continuous casting method for producing thixotropic metallic alloys containing degenerated dendrites. It consists of casting the liquid metal in a movable occluded mould consisting of a hot upstream zone produced from insulating material and a cooled downstream zone in which the metal solidifies, while carrying out by means of a sliding magnetic field, obtained by a series of polyphase inductors, an electromagnetic agitation which causes the dendrites formed in the cold zone to pass into the hot zones where they change to nodules by superficial refusion.

U.S. Pat. No. 5,865,238, which issued to Carden et al. on Feb. 2, 1999, describes a process for die casting of metal matrix composite materials from a self-supporting billet. The billet is formed of an aluminum alloy matrix and ceramic particles. It is heated in an oxygen containing atmosphere forming an aluminum oxide surface and softening the matrix alloy. The semi-solid billet then is compressed in a die casting sleeve and the softened matrix material is displaced into a die to form the shape.

U.S. Pat. No. 6,098,700, which issued to Carden et al. on Aug. 8, 2000, describes an apparatus for die casting of metal matrix composite materials from a self-supporting billet. The billet is composed essentially of a metal alloy matrix and dispersed ceramic particles. It comprises heating means to soften the metal alloy, a horizontal plunger to drive and to compress the billet, a die through which the softened metal matrix and ceramic particles are formed into a shape defined by the interior surface of the die, and cooling means to maintain the temperature of the interior surface of the die at a predetermined temperature.

U.S. Pat. No. 6,399,017, which issued to Norville et al. on Jun. 4, 2002, discloses a method and apparatus for containing and ejecting a thixotropic metal slurry. A container system includes a vessel for holding a thixotropic semi-solid aluminum alloy slurry during its processing as a billet and an ejection system for cleanly discharging the processed thixotropic semi-solid aluminum billet. The crucible is preferably formed from a chemically and thermally stable material. The crucible defines a mixing volume. The crucible ejection mechanism may include a movable bottom portion mounted on a piston or may include a solenoid coil for inducing an electromotive force in the electrically conducting billet for urging it from the crucible.

U.S. Pat. No. 6,402,367, which issued to Lu et al. on Jun. 11, 2002, discloses a method and apparatus for magnetically stirring a thixotropic metal slurry. The aluminum alloy comprises a first solid particulate phase suspended in a second liquid phase so as to maintain its thixotropic character by degenerating forming dendritic particles into spheroidal particles while simultaneously equilibrating the melt temperature by quickly transferring heat between the melt and its surroundings. The melt is stirred by a magnetomotive force field generated by a stacked stator assembly.

U.S. Pat. No. 6,432,160, which issued to Norville et al. on Aug. 13, 2002, discloses a method and apparatus for making a thixotropic metal slurry. It comprises simultaneously controlledly cooling and stirring the melt to form solid particles of a first phase suspended in a residual liquid second phase. Vigorous stirring of the metallic melt results in the formation of degenerate dendritic particles having substantially spheroidal shapes.

U.S. Pat. No. 6,637,927, which issued to Lu et al. on Oct. 28, 2003, discloses a method and apparatus for magnetically stirring a thixotropic metal slurry. A melt is stirred by a magnetomotive force field generated by a stacked stator assembly. The stacked stator assembly includes a stator ring adapted to generate a linear/longitudinal magnetic field positioned between two stator rings adapted to generate a rotational magnetic field. The stacked stator rings generate a substantially spiral magnetomotive mixing force and define a substantially cylindrical mixing region therein.

U.S. Pat. No. 6,932,938, which issued to Norville et al. on Aug. 23, 2005, discloses a method and apparatus for containing and ejecting a thixotropic metal slurry. A crucible is preferably formed from a chemically and thermally stable material such as graphite or a ceramic. The crucible defines a mixing volume. The crucible ejection mechanism may include a movable bottom portion mounted on a piston or may include a solenoid coil for inducing an electromotive force in the electrically conducting billet for urging it from the crucible.

U.S. Pat. No. 6,962,189, which issued to Buckley on Nov. 8, 2005, describes a method of making precision castings using thixotropic materials. Precision castings requiring a fine finish and having complex internal geometries can be produced by casting a semi-solid thixotropic metal alloy within or about a meltaway material component in the form of a core and/or a die insert that has a lower melting point than the solid to semi-solid transition temperature of the thixotropic alloy.

U.S. Pat. No. 7,132,077, which issued to Norville et al. on Nov. 7, 2006, discloses a method and apparatus for containing and ejecting a thixotropic metal slurry. During processing, a molten aluminum alloy precursor is transferred into the crucible and vigorously stirred and controllably cooled to form a thixotropic semi-solid billet. Once the billet is formed, the ejection mechanism is activated to discharge the billet from the crucible. The billet is discharged into a shot sleeve and immediately placed in a mold and molded into a desired form.

U.S. Pat. No. 7,296,611, which issued to Hirai et al. on Nov. 20, 2007, describes a method and apparatus for manufacturing metallic parts by die casting. An injection molding apparatus includes a melt furnace and a metal supply system located in the melt furnace. The metal supply system includes a pump. The injection molding apparatus also includes a first metal inlet from the melt furnace to the metal supply and a vertical injection mechanism adapted to inject liquid metal into a die system. The injection molding apparatus also includes a second metal inlet from the metal supply system to the vertical injection mechanism.

The patents described above are hereby expressly incorporated by reference in the description of the present invention.

SUMMARY OF THE INVENTION

A die casting method, in accordance with a preferred embodiment of the present invention, comprises the steps of providing a die having a cavity which generally defines the shape of a component to be cast, wherein the die has an opening formed in a first surface of the cavity and a conduit formed in a second surface of the cavity, pushing a billet through the opening and toward the second surface, causing the billet to deform and flow into the cavity to form the component, and directing air to flow through the conduit and away from the cavity as the billet is deformed.

In a particularly preferred embodiment of the present invention, the billet is a semi-solid metal, such as aluminum, as the pushing step is commenced and the air is directed to flow through a plurality of axial passages formed in a generally cylindrical rod. The billet has a rear surface against which a force is exerted to accomplish the pushing step and a generally concave surface which is the first portion of the billet to contact the second surface. In a particularly preferred embodiment of the present invention, it further comprises the steps of moving the concave surface into contact with the second surface and exerting a continuing force to force the billet against the second surface and cause air to flow from within a depression of the concave surface and into the conduit. It can further comprise the step of selecting a billet size which results in a portion of the billet, proximate the rear surface of the billet, extending from the cavity opening after a majority of the billet has flowed into the cavity and the component is formed. It can further comprise the step of removing an outer cylindrical portion of the billet as it moves toward the second surface. The outer cylindrical portion of the billet can be removed by scraping it from the billet because the outer dimension of the billet is greater than a minimum dimension of the opening. The present invention can further comprise the step of receiving a portion of the concave surface in a part of the cavity which is associated with a part of the component that is intended to be discarded after the component is removed from the die.

BRIEF DESCRIPTION OF THE DRAWINGS

The present invention will be more fully and completely understood from a reading of the description of the preferred embodiment in conjunction with the drawings, in which:

FIGS. 6 and 7 show an alternative embodiment of the present invention; and FIG. 8 is an enlarged view of a rod having air conduits formed on its outer cylindrical surface.

DESCRIPTION OF THE PREFERRED EMBODIMENT

Figure 1:
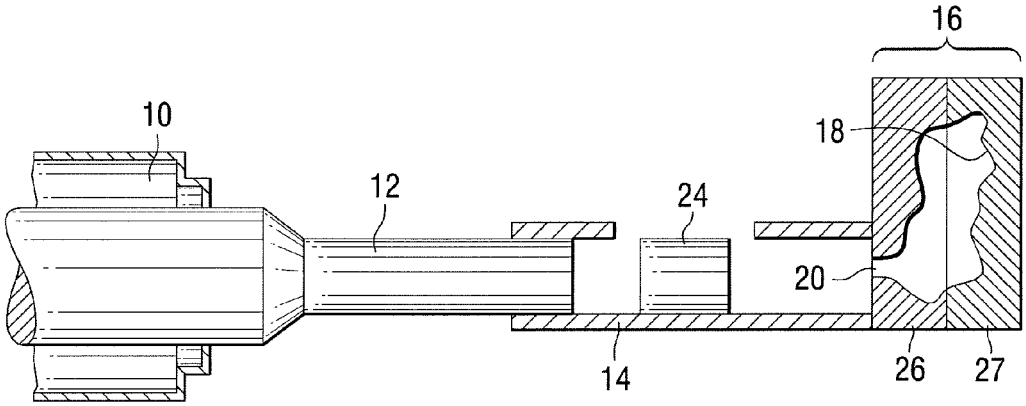
FIG. 1 PRIOR ART
FIG. 1 shows a known type of die casting machine.

Throughout the description of the preferred embodiment of the present invention, like components will be identified by like reference numerals.

As is generally known to those skilled in the art, certain conditions which exist during a die casting procedure can result in flaws in a finished die cast component. As an example, entrained air can be captured within portions of the finished die cast component. This can lead to unacceptable surface conditions or weakened portions of the die cast product. In addition, entrapped aluminum oxide within the die cast component can produce flaws or weakened regions. When die casting semi-solid metal, such as aluminum, the shape of the billet prior to the die casting process can adversely affect the quality of the finished product. The various embodiments of the present invention are directed to the avoidance of casting flaws that result from certain processing conditions which will be described in greater detail below.

FIG. 1 is a schematic illustration of a die casting machine which comprises a cylinder 10, a plunger 12, a trough 14 and a die 16. The die 16 defines a cavity 18 which has an opening 20. A billet 24 is positioned to be pushed by the plunger 12, or piston, to the right in FIG. 1, through the opening 20 and into the cavity 18 to form a die cast component. The die 16 comprises two portions, 26 and 27, which can be separated to remove the component from the cavity 18 after the metal solidifies. As described in U.S. Pat. Nos. 5,863,238 and 6,098,700, the billet 24 can be a semi-solid metal, such as aluminum.

Figure 2:
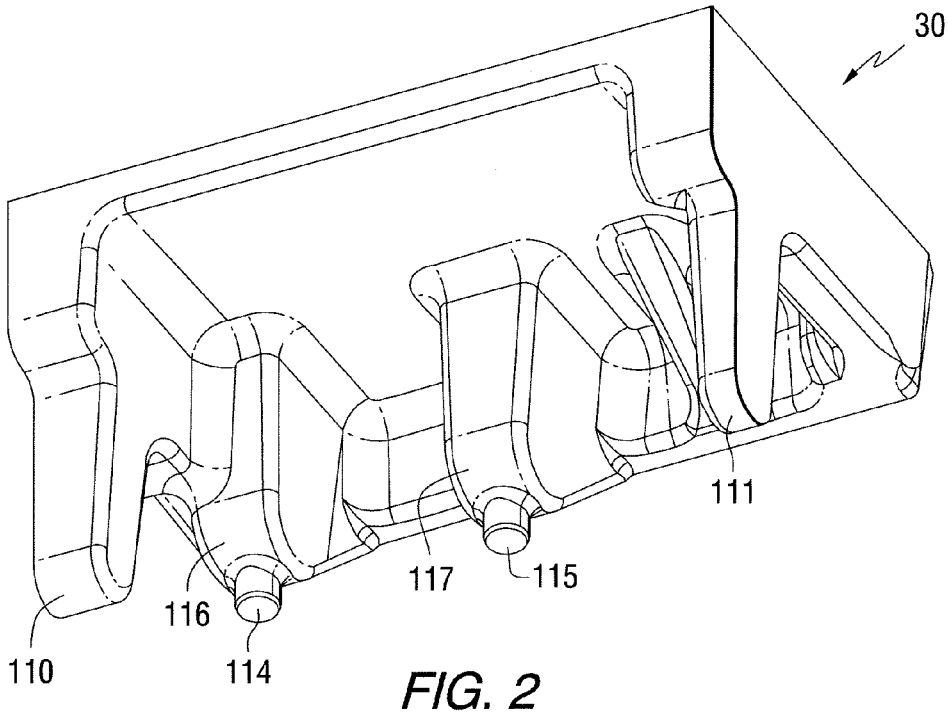
FIG. 2 PRIOR ART
FIG. 2 shows a product that can be made by the present invention.

FIG. 2 is an isometric representation of an anchor bracket for use in conjunction with an outboard motor. A preferred embodiment of the present invention will be described below in conjunction with the anchor bracket 30 shown in FIG. 2.

Figure 3:
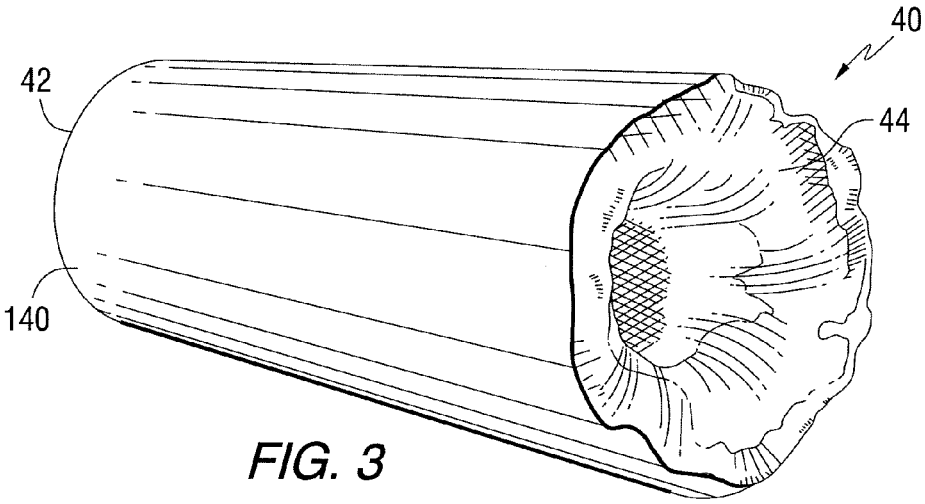
FIG. 3 shows a semi-solid billet prior to the die casting process of the present invention.

FIG. 3 illustrates a billet 40 of semi-solid metal, such as aluminum, which is intended for use in conjunction with a preferred embodiment of the present invention. The billet 40 has a rear surface 42 and a generally concave surface 44. The concavity of the concave surface 44 results from its method of manufacture. Since the molten metal is rotationally stirred during its transition to the semi-solid state, the concave end 44 retains this shape as it becomes semi-solid. In addition, the metal contracts during this process to further deepen the depression in the concave end 44. As will be described in greater detail below, the billet 40 will eventually become the finished component illustrated in FIG. 2 after the die casting process is complete and certain portions of the die cast component are removed.

Figure 4A:
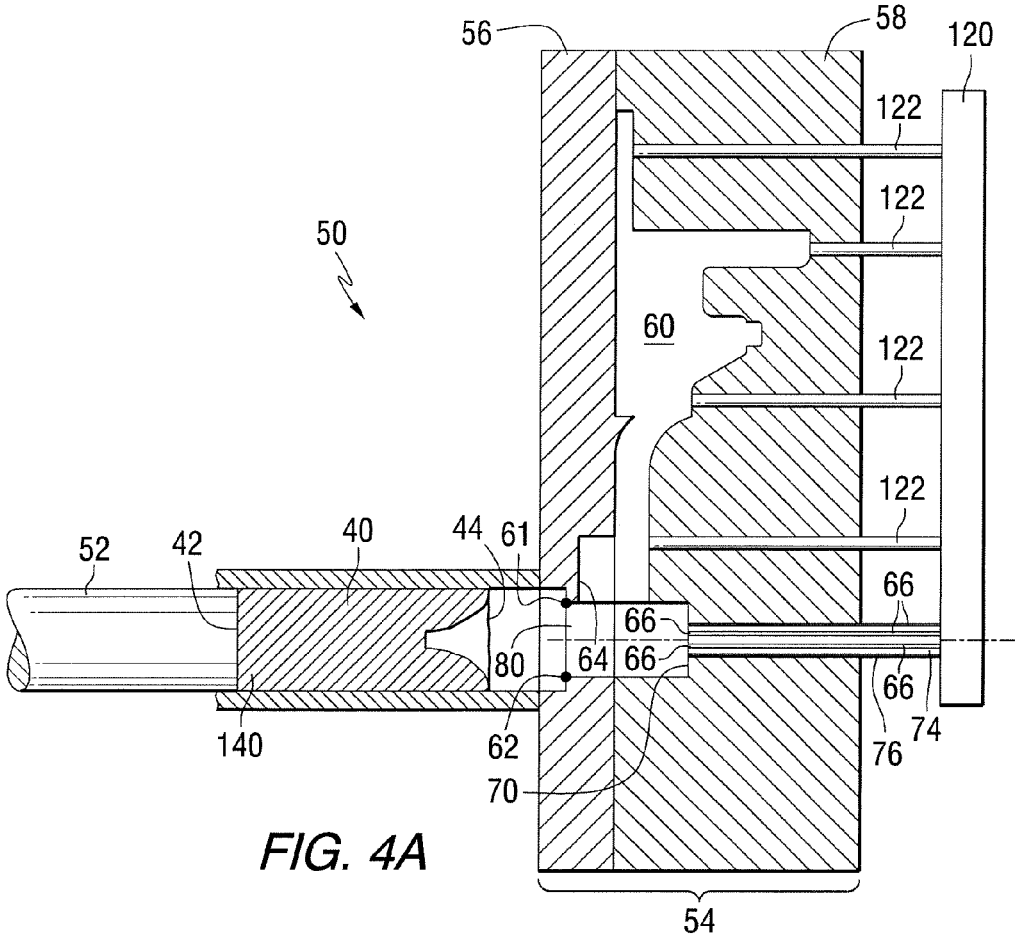
FIGS. 4A-4C show three sequential stages of practicing a method of a preferred embodiment of the present invention.
Figure 4B:
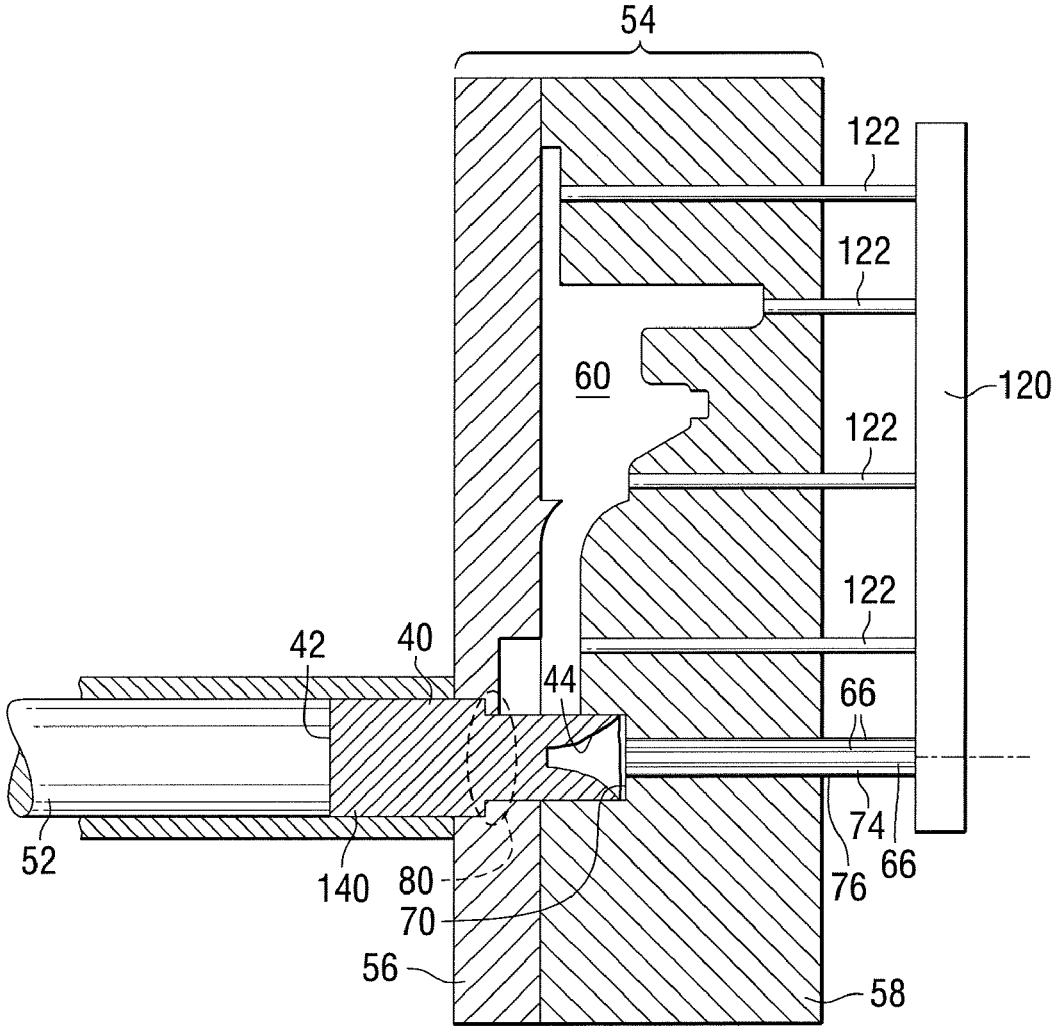
Figure 4C:
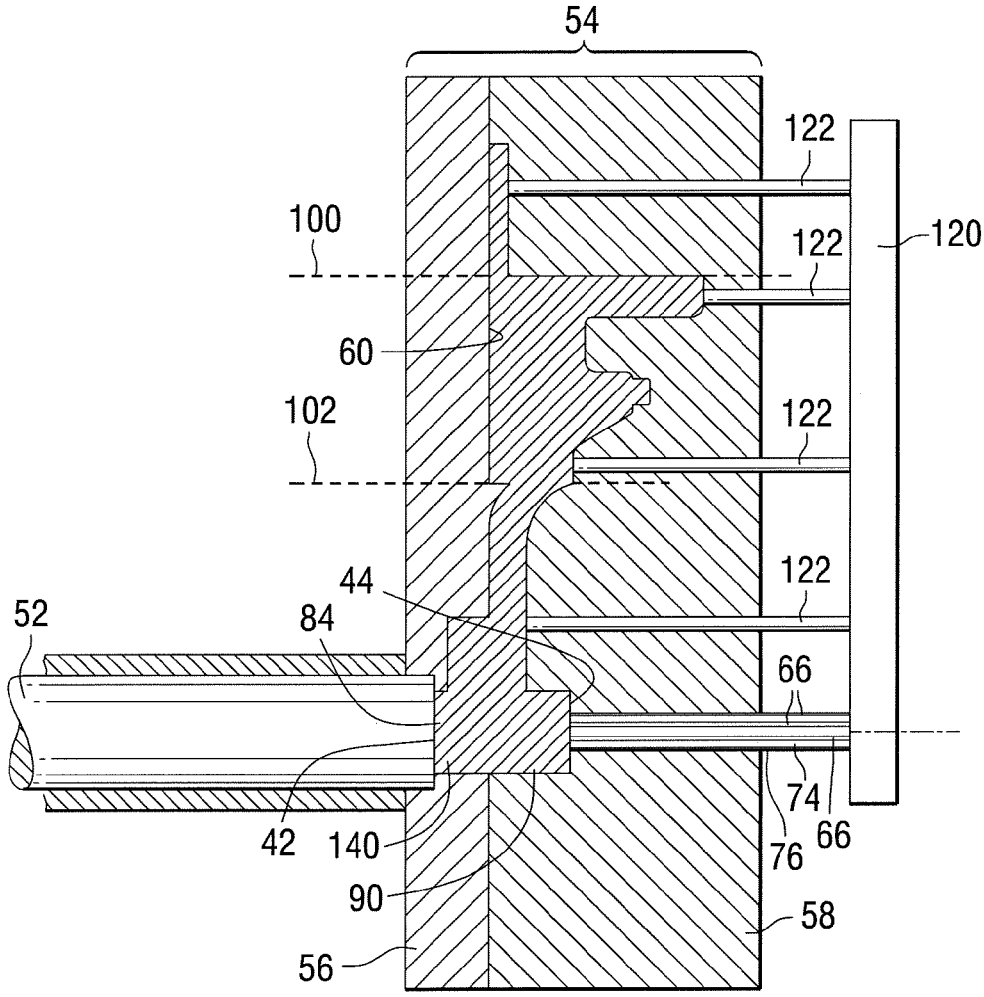

FIGS. 4A-4C illustrate a die cast machine during sequential periods of transforming the billet 40 of FIG. 3 into the die cast component shown in FIG. 2.

In FIG. 4A, a die cast machine 50 is schematically illustrated. A plunger 52, or piston, is positioned to exert a force (toward the right in FIG. 4A) against the rear surface 42 of the billet 40. A die 54 comprises two separable portions, 56 and 58. The die 54 has a cavity 60 which generally defines the shape of a component (such as the anchor bracket 30 described above in conjunction with FIG. 2) to be cast. The die has an opening which is shown between points 61 and 62 in FIG. 4A. The opening is formed in a first surface 64 of the cavity 60. A conduit, which can be a plurality of passages 66, is formed in a second surface 70 of the cavity 60. The air passages 66 which make up the conduit can be a plurality of axial flat strips machined onto the outer surface of a rod 74 or any other technique which allows the passage of air from the cavity 60 to a point of atmospheric pressure, such as region 76 which is outside of the die 54.

In FIG. 4A, the billet 40 is shown prior to its passage through the opening 80. The plunger 52, or piston, can push the billet 40 toward the right in FIG. 4A, through opening 80, and toward the second surface 70. As the plunger 52 continues to exert a force in a direction toward the right in FIG. 4A, the billet 40 is caused to move into contact with the second surface 70 and begin to deform as it continues to be compressed by the plunger 52. This, in turn, causes the semi-solid to metal of the billet 40 to flow into the upper portions of the cavity 60.

FIG. 4B shows the billet 40 after it has been pushed by the plunger 52 into contact with the second surface 70. The opening 80 of the die 54 causes the diameter of the billet 40 to be reduced as a result of its outer surface being scraped by the dimension of the opening 80 compared to the original diameter of the billet 40. This scraping tends to remove an outer oxidation surface from the billet 40 and push that cylindrical surface toward the left in FIG. 4B relative to the billet 40 which continues to move toward the right. In FIG. 4B, the billet 40 is shown as it would generally appear at the instant when its concave surface moves into contact with the second surface 70 of the die 54.

With reference to FIGS. 3 and 4B, it should be understood that air is typically trapped within the concavity of the concave end 44 of the billet 40. One of the several important functions of the present invention is to provide a way to allow the air within the concavity to be removed through the second surface 70 so that it is not entrained within the semi-solid metal as that metal moves upwardly into the component forming portion of the cavity 60.

FIG. 4C shows the procedure at a later stage than FIGS. 4A and 4B. In FIG. 4C, the billet has been pushed into the cavity 60 to the full operational travel of the plunger 52. This has caused it to be deformed and the continuous force exerted by the plunger 52 also caused the semi-solid metal to flow upwardly into the cavity 60 to form the finished die cast component.

With continued reference to FIG. 4C, several benefits of the present invention should be noted. First, the air is allowed to escape from the concavity of the billet through the axial passages 66 of the generally cylindrical rod 74 so that it is not trapped within the solidified metal when the component is completed. Also, the material on the surface of the concavity at the concave end 44 of the billet 40, as described above in conjunction with FIG. 3, is trapped within the protrusion 90 that extends toward the right of the bottom portion of the finished part. Furthermore, the rear surface 42 of the billet is easily removed with the scrapped portion which is the lower part of the finished die cast product. That rear surface 42 remains in the region identified by reference numeral 84 in FIG. 4C. Because the rear surface 42 of the billet 40 is typically partially solidified because of its contact with various colder plungers that are used during the die casting process, its more solid state would adversely affect the quality of the finished part if it was allowed to become a part of the final component. Instead, that rear surface 42 is contained within portion 84 after the semi-solid metal solidifies and is removed from the die 54. Therefore, portions 84 and 90 of the finished die cast product are likely to contain impurities which can easily be removed from the final component after it is removed from the die 54.

With reference to FIGS. 2 and 4A-4C, it can be seen that the die cast product shown in FIG. 4C contains scrap portions in addition to the finished die cast product shown in FIG. 2. As an example, the portions of the die cast part above dashed line 100 and below dashed line 102 are removed after the completed component is removed from the die 54. The remaining portion, between lines 100 and 102, is the anchor bracket 30 shown in FIG. 2. It should be clearly understood that the section views in FIGS. 4A-4C are not precisely drawn with respect to a single plane cutting through the die 54 and the die cast component. Instead, the section view is selected so that it can be more easily compared to the actual component shown in FIG. 2. For purposes of cross reference, the extensions, 110 and 111, of the anchor bracket 30 are identified in FIG. 2 and extension 110 is identified in FIG. 4C. In addition, protrusions 116 and 117 of the anchor bracket 30 are identified in FIG. 2 and protrusion 116 is identified in FIG. 4C. Similarly, the extensions, 114 and 115, are identified in FIG. 2 and extension 114 is identified in FIG. 4C. It can be seen that the anchor bracket 30 in FIG. 2 is the portion of the die cast product that is between dashed lines 100 and 102 in FIG. 4C.

Figure 5:
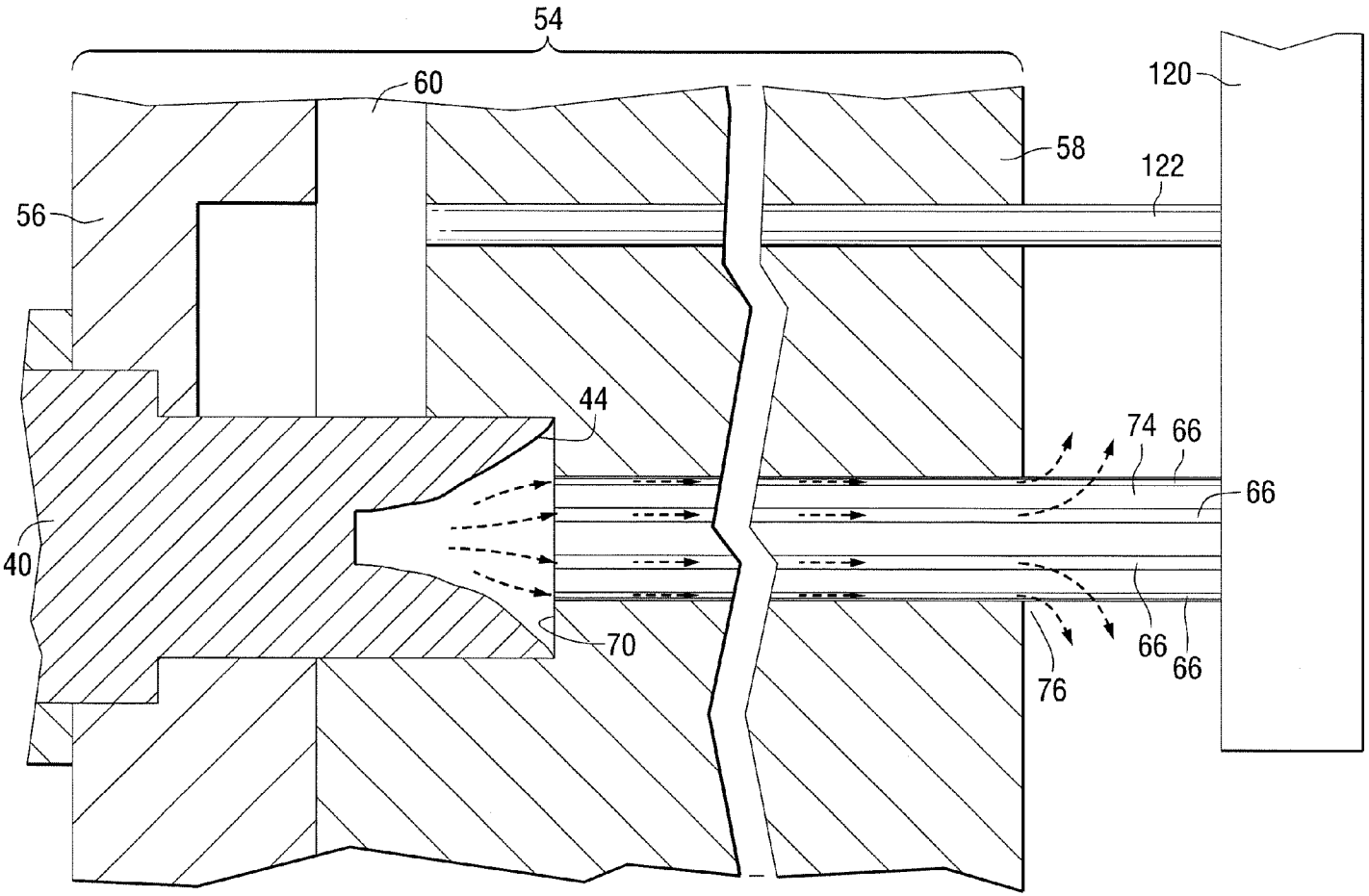
FIG. 5 is an enlarged partial sectional view of FIG. 4B.

FIG. 5 is an enlarged section of FIG. 4B which is provided in order to more clearly show the air conduit which is provided for the purpose of reducing the amount of entrained air that is allowed to flow upwardly into the finished component along with the semi-solid metal as described above. The air conduit compresses a plurality of flat portions 66 that form air passages away from the concavity of the concave surface 44, through the second surface 70 of the die and toward region 76 which is at atmospheric pressure. This flow of air is illustrated by the dashed line arrows in FIG. 5. As the billet 40 is continually compressed by the plunger, as described above, the concavity of the concave surface 44 continues to collapse and expel the air contained within it. This expulsion of air and its passage through the conduit removes the air and prevents it from being entrained in the finished die cast product.

With continued reference to FIGS. 4A-4C and 5, a core pin plate 120 is shown with a plurality of core pins 122 attached to it. When the die cast product is properly solidified, the two sections of the die, 56 and 58, are separated and the core pin plate 120 is pushed toward the die section 58 to eject the finished part from the cavity 60. The generally cylindrical rod 74, which is provided with the plurality of air passages 66, is also urged in the same direction as the core pins 122 during this procedure. It assists in ejecting the part from portion 58 of the die.

During this procedure, the air that is originally within the concavity of the concave surface 44 of the billet 40 is allowed to escape through the passages 66 to region 76. In addition, in at least one embodiment of the present invention, a small amount of semi-solid metal, such as aluminum, travels into the leftmost portions of the passages 66. Since these passages are small, as will be described in greater detail below, the ejection of the finished component from the die results in these small extensions of metal being pulled out of the passages 66 to remain with a finished die cast product and be removed along with the remaining portions of the product below dashed line 102 in FIG. 4C.

FIG. 6 is an enlarged view of the generally cylindrical rod 74. In the alternative embodiment of the present invention shown in FIG. 6, the passages 66 are shown as semi-circular grooves machined in its outer surface. It should be understood that the machining of semi-circular grooves for this purpose is an alternative embodiment of the present invention. A preferred embodiment comprises flat surfaces milled in the outer cylindrical surface of the rod 74.

FIG. 7 is a section view taken through the rod 74. It shows the rod 74 disposed within a cylindrical opening of die portion 58. It should be understood that FIGS. 6 and 7 are intended to illustrate the air passages 66 more clearly than is possible if the actual preferred embodiment used in practice is illustrated. This can be seen in FIG. 8 which shows an illustration of an air passage 66 formed by machining a flat surface 130 in the outer cylindrical surface 132 of the rod 74. The actual distance, measured along a line perpendicular to surface 130 and along a diameter of the rod 74, is approximately 0.008 to 0.010 inches in length. This very small air passage 66 is sufficient to allow the air to flow out of the concavity at the concave end of the billet, but the semicircular grooves shown in FIGS. 6 and 7 are provided to more clearly show the relative positions of the air passages 66 and their number. In a preferred embodiment of the present invention, eight air passages 66 were formed by machining the flat surfaces 130, described above in conjunction with FIG. 8, at generally equally spaced positions around the outer cylindrical surface of the rod 74.

As described above in conjunction with FIGS. 1-8, the method of the present invention provides several important advantages when die casting a product from a semi-solid billet 44. The manufacture of the billet 44 results in a rear surface 42 that can be partially solidified from its contact with colder plungers used to remove it from a furnace and another plunger 52 used to push it into the die 54. This potentially solidified portion 140 of the billet 40 illustrated in FIG. 3 could cause defects in a finished die cast component. However, that portion 140 is retained in the region identified by reference numeral 84 in FIG. 4C. It is removed, as is portion 90, when the part of the finished die cast product below dashed line 102 is removed. In addition to the provisions of portions 84 and 90 for these purposes, the air passages 66 and the rod 74 remove air from the concavity of the concave surface 44 to avoid entraining the air in the finished product.

Although the present invention has been described with particular detail and illustrated to show preferred embodiments, it should be understood that alternative embodiments are also within its scope.

We claim:

1. A die casting method, comprising the steps of:

providing a die having a cavity which generally defines the shape of a component to be cast, said die having an opening formed in a first surface of said cavity of said die and an air conduit formed in a second surface of said cavity, said air conduit being disposed in fluid communication between said cavity and the atmosphere;

pushing a billet along a path which extends through said opening and toward said second surface, said billet being a semi-solid metal as said pushing step is commenced;

causing said billet to deform and flow into said cavity to form said component; and directing air to flow through said conduit and away from said cavity as said billet is deformed, said air being directed to flow through at least one axial passage formed in a generally cylindrical rod and extending through a portion of said second surface, said billet having a rear surface against which a force is exerted to accomplish said pushing step and a generally concave front surface as said billet is pushed through said opening.

2. The method of claim 1, further comprising:

moving said concave surface into contact with said second surface; and exerting a continuing force to compress said billet against said second surface and cause air to flow from within a depression of said concave surface and into said conduit.

3. The method of claim 2, further comprising:

selecting a billet size which results in a portion of said rear surface extending from said cavity opening after a majority of said billet has flowed into said cavity and said component is formed.

4. The method of claim 3, further comprising:

removing an outer cylindrical portion of said billet as it moves toward said second surface.

5. The method of claim 4, wherein:

said outer cylindrical portion of said billet is removed by scraping it from said billet because said outer dimension of said billet is greater than a minimum dimension of said opening.

6. The method of claim 5, further comprising:

receiving a portion of said concave surface in a part of said cavity which is associated with a part of said component that is intended to be discarded after said component is removed from said die.

7. A die casting method, comprising the steps of:

providing a die having a cavity which generally defines the shape of a component to be cast, said die having an opening formed in a first surface of said cavity of said die and a conduit formed in a second surface of said cavity;

pushing a billet through said opening and toward said second surface, said billet having a rear surface against which a force is exerted to accomplish said pushing step and a generally concave surface which is the first portion of said billet to contact said second surface;

causing said billet to deform and flow into said cavity to form said component;

directing air to flow through said conduit and away from said cavity as said billet is deformed;

receiving a portion of said concave surface in a part of said cavity which is associated with a part of said component that is intended to be discarded after said component is removed from said die;

moving said concave surface into contact with said second surface; and exerting a continuing force to compress said billet against said second surface and cause air to flow from within a depression of said concave surface and into said conduit.

8. The method of claim 7, wherein:

said billet is a semi-solid metal as said pushing step is commenced.

9. The method of claim 7, further comprising:

removing an outer cylindrical portion of said billet as it moves toward said second surface, said outer cylindrical portion of said billet being removed by scraping it from said billet because said outer dimension of said billet is greater than a minimum dimension of said opening.

10. The method of claim 7, wherein:

said air is directed to flow through a plurality of axial passages formed in a generally cylindrical rod and out of said cavity.

11. The method of claim 7, further comprising:

selecting a billet size which results in a portion of said billet, proximate said rear surface, extending from said cavity opening after a majority of said billet has flowed into said cavity and said component is formed.

* * * * *